US006630803B1

(12) United States Patent
Sluyterman et al.

(10) Patent No.: US 6,630,803 B1
(45) Date of Patent: Oct. 7, 2003

(54) COLOR DISPLAY DEVICE HAVING QUADRUPOLE CONVERGENCE COILS

(75) Inventors: Albertus Aemilius Seyno Sluyterman, Eindhoven (NL); Wilhelmus Henrica Cornelis Theuws, Eindhoven (NL); Tjerk Gerrit Spanjer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 393 days.

(21) Appl. No.: 09/762,464

(22) PCT Filed: Jun. 19, 2000

(86) PCT No.: PCT/EP00/05646

§ 371 (c)(1),
(2), (4) Date: Feb. 7, 2001

(87) PCT Pub. No.: WO00/79561

PCT Pub. Date: Dec. 28, 2000

Related U.S. Application Data

(63) Continuation of application No. 09/338,049, filed on Jun. 22, 1999, now Pat. No. 6,411,027.

(30) Foreign Application Priority Data

Apr. 27, 2000 (EP) ..... 00201506

(51) Int. Cl.[7] ..... H01J 29/51

(52) U.S. Cl. ..... 315/368.11; 315/368.25; 315/368.28

(58) Field of Search ..... 315/368.11, 368.25, 315/368.26, 368.27, 368.28; 313/412, 413, 421

(56) References Cited

U.S. PATENT DOCUMENTS

| | | | | | |
|---|---|---|---|---|---|
| 3,906,418 | A | * | 9/1975 | Doshi et al. | 335/210 |
| 5,006,754 | A | * | 4/1991 | Barten | 313/412 |
| 5,327,051 | A | * | 7/1994 | Johnson et al. | 315/368.28 |

FOREIGN PATENT DOCUMENTS

| | | | |
|---|---|---|---|
| EP | 0421523 B1 | 6/1995 | H01J/29/56 |
| WO | WO9934392 | 7/1999 | H01J/29/70 |

* cited by examiner

*Primary Examiner*—Don Wong
*Assistant Examiner*—Thuy Vinh Tran

(57) ABSTRACT

The invention relates to a color display device comprising an in-line electron gun (5) for generating three electron beams (6, 7, 8), and a convergence unit (14') to dynamically influence the convergence of the electron beams and deflecting means (51) for deflecting the electron beams (6, 7, 8). The convergence unit (14') comprises a ring-shaped element (21'), said ring-shaped element comprising two parts, a first part (60) being positioned closer to the in-line gun (5) than a second part (68), and the first and/or the second part having four coils (22') for generating a magnetic quadrupole field.

5 Claims, 3 Drawing Sheets

COLOR DISPLAY DEVICE HAVING QUADRUPOLE CONVERGENCE COILS

This application is a continuation of Ser. No. 09/338,049 filed Jun. 22, 1999 now U.S. Pat. No. 6,411,027.

BACKGROUND OF THE INVENTION

The invention relates to a color display device comprising an in-line electron gun for generating three electron beams, and a unit for deflecting the electron beams across a color selection electrode.

Such display devices are known.

A current aim is to make the outer surface of the color display window flatter, so that the image displayed on the display window is perceived by the viewer as flat. However, an increase of a radius of curvature of the outer surface will lead to an increase of a number of problems. The radius of curvature of the inner surface of the display window and of the color selection electrode should increase, and, as the color selection electrode becomes flatter, the mechanical strength of the color selection electrode decreases and hence the sensitivity to doming and vibrations increases. An alternative solution to this problem would be to curve the inner surface of the display window more strongly than the outer surface. By virtue thereof, a color selection electrode having a relatively small radius of curvature can be used. As a result, doming and vibration problems are reduced, but other problems occur instead. The display window has a much larger thickness at the edges than in the center. As a result, the weight of the display window increases and the intensity of the image decreases substantially towards the edges.

EP 0,421,523 discloses a color cathode ray tube with an in-line gun, a pincushion correcting yoke and an eyebrow effect electron-optical distortion correction device comprising two pairs of coils, each pair having a coil on each outer electron beam side of the neck in the plane of the beams. The coil pairs are spaced apart along the z-axis between the gun and the yoke and are driven by a sawtooth current having a bow-tie envelope synchronous with the raster scan to correct the dynamic, asymmetrical eyebrow effect apparent as a purity defect on the raster.

WO 99/34392 describes a color display device comprising a color cathode ray tube including an in-line electron gun for generating three electron beams, a color selection electrode, deflecting means for deflecting the electron beams located at a deflection plane, and first and second influencing means to dynamically influence the convergence of the electron beams, to decrease a distance between the electron beams at a location of the deflection plane.

The presence of the influencing means may introduce some undesired image artifacts. The so-called East/West raster distortion may be influenced, as well as the linearity of the deflection of the electron beams in a vertical direction. In conventional cathode ray tubes, deflection in the vertical direction is not a linear function of the deflection current. This non-linearity is corrected electronically. Introduction of the first and second influencing means leads to a cathode ray tube in which the non-linearity is reduced or is even overcompensated. These effects are undesired.

SUMMARY OF THE INVENTION

It is an object of the invention to provide an improved color display device. To this end, the invention provides a color display device and a deflection unit as defined in the independent claims. The dependent claims describe advantageous embodiments.

BRIEF DESCRIPTION OF THE DRAWINGS

These and other objects of the invention are apparent from and will be elucidated with reference to the embodiments described hereinafter.

In the drawings.

The Figures are not drawn to scale. In the Figures, like reference numerals generally refer to like parts.

DETAILED DESCRIPTION OF THE PREFERRED EMBODIMENTS

Figure 1:
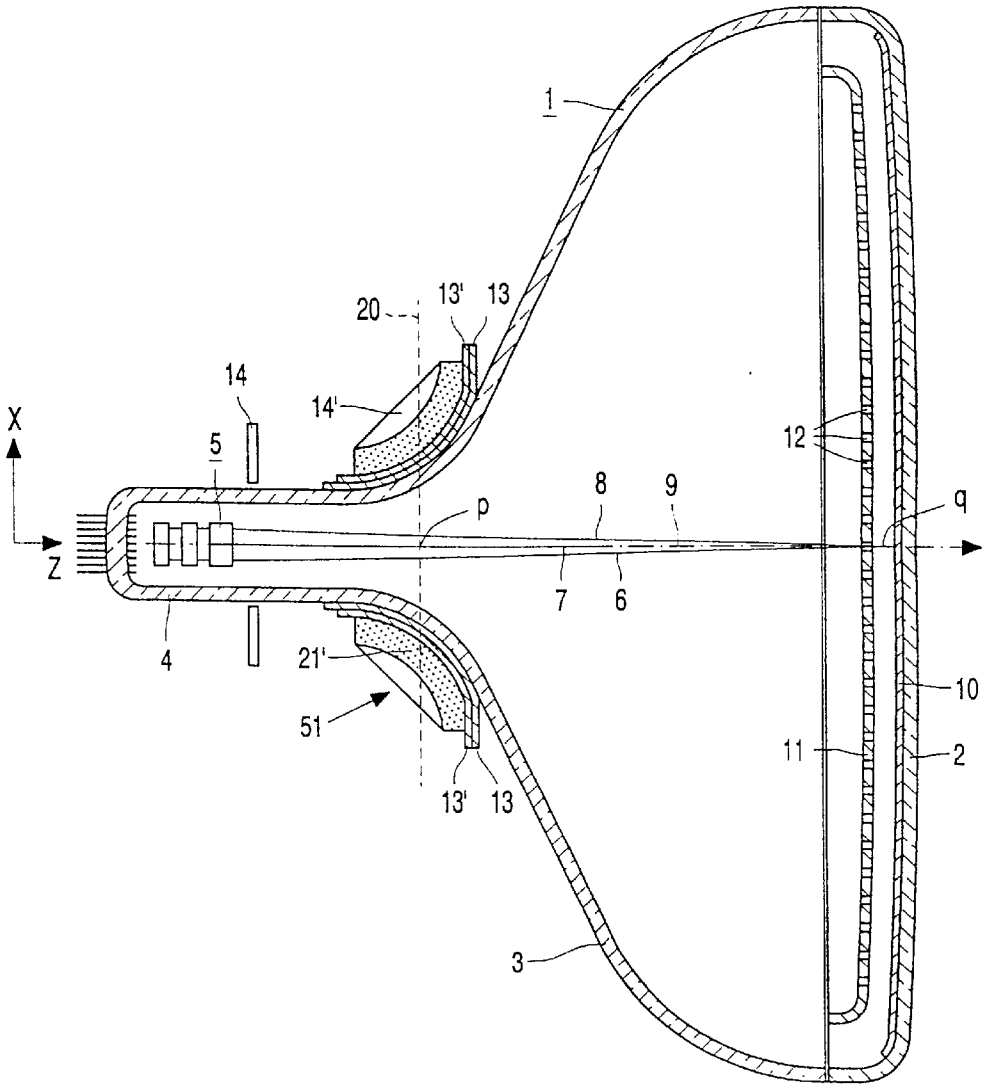
FIG. 1 is a sectional view of a color display device.

The display device shown in FIG. 1 comprises a color cathode ray tube having an evacuated envelope 1 which includes a display window 2, a cone portion 3 and a neck 4. The neck 4 accommodates an in-line electron gun 5 for generating three electron beams 6, 7 and 8 which extend in one plane, the in-line plane, extending in an X-direction of a rectangular X-Z coordinate system. In the undeflected state, the central electron beam 7 substantially coincides with the tube axis 9, which extends in the Z-direction. A third direction, the Y-direction extends in a direction perpendicularly to the in-line plane (not shown in the Figure). Conventionally, during operating conditions, the tube is positioned in such a way that the X-Z plane coincides with a horizontal plane and the Y-direction coincides with a vertical direction.

The inner surface of the display window is provided with a display screen 10. The display screen 10 comprises a large number of phosphor elements luminescing in red, green and blue. On their way to the display screen, the electron beams are deflected across the display screen by way of an electromagnetic deflection unit 51 and pass through a color selection electrode 11 which is arranged in front of the display window 2 and comprises a thin plate having apertures 12. The three electron beams 6, 7 and 8 pass through the apertures 12 of the color selection electrode at a small angle relative to each other, and hence each electron beam impinges only on phosphor elements of one color. In addition to a coil holder 13, the deflection unit 51 comprises deflection coils 13' for deflecting the electron beams in two mutually perpendicular directions. A ring-shaped element 21', the so-called yoke ring, is positioned around the deflection coils 13'. The purpose of the yoke ring, conventionally comprising ferrite, is to 'short-circuit' magnetic lines of flux outside the coils. Without a yoke ring, excessively high currents through the deflection coils would otherwise have to be used and also disturbing (magnetic) stray fields would occur. The display device further includes means for generating voltages, which during operation are fed to components of the electron gun via feedthroughs. The deflection plane 20 is schematically indicated as well as the distance p between the electron beams 6 and 8 in this plane, and the distance q between the color selection electrode and the display screen. The distance q is inversely proportional to the distance p.

The color display device comprises two electron beam convergence influencing units 14, 14', a first unit 14 being used, in operation, to dynamically bend, i.e. as a function of the deflection in a direction, the outermost electron beams towards each other, and a second unit 14' being used to dynamically bend the outermost electron beams in opposite directions. The unit 14 bends the electron beams towards each other, and the unit 14' bends the electron beams in opposite directions. As a result, the distance between the electron beams is smaller for deflected electron beams than for undeflected beams. Since the distance p is smaller, the distance q may increase, which leads to an additional freedom of design with respect to the curvature of the color selection electrode. The freedom of design is used to increase the curvature of the color selection electrode having a positive effect on the strength of the color selection electrode, while the sensitivity to doming and vibration decreases.

The two units 14, 14' are positioned at some distance from each other. The first unit 14 is positioned close to the gun and will be referred to as the "gun quadrupole", whereas the second unit 14' is located near or at the deflection unit and will be referred to as the "yoke quadrupole". It is convenient to integrate the unit 14' and the deflection unit 51 by winding four coils on the ring-shaped element 21', which coils generate a dynamic electromagnetic quadrupole field.

During operation, the units 14, 14' influence the deflection of the electron beams, which may lead to unwanted artifacts in the image displayed on the window 2.

In conventional cathode ray tubes (CRTs), deflection in the vertical (Y-) dimension is a non-linear phenomenon, i.e. the displacement of the electron beams is a non-linear function of the current through the deflection coils. Deflection of the beams requires relatively less current at the extreme sides of the display window. An electronic way of correcting the non-linearity, the so-called vertical S-correction, takes place within the television set in which the tube is applied. Due to the action of the yoke quadrupole the deflection of the electron beams is a more linear process, which implies that the S-correction overcorrects the non-linear deflection phenomenon. This is undesired.

Conventional CRTs are also corrected for so-called East-West pincushion raster distortion (East and West are indications of the two vertical sides of the display window). This means that an image consisting of a rectangular raster of horizontal and vertical lines is displayed on the screen as a distorted cushion-like shape, in which the vertical lines close to the border of the display window are bent inwards. It appears that application of the unit 14' increases this image artifact.

The invention aims to reduce the influence of the unit 14' on the above indicated image artifacts. The invention is based on the recognition that the unit 14' has its main influence at the side of the ring-shaped element 21' that faces the display window 2. It is therefore proposed to split the ring-shaped element 21' into two (axially split) parts, and to wind the quadrupole coils on one of the two parts. Preferably, the quadrupole coil is wound around the core part closest to the electron gun. The measure provides the opportunity to shift the two core parts independently of each other, thus improving raster and convergence performance of the tube.

Figure 2A:
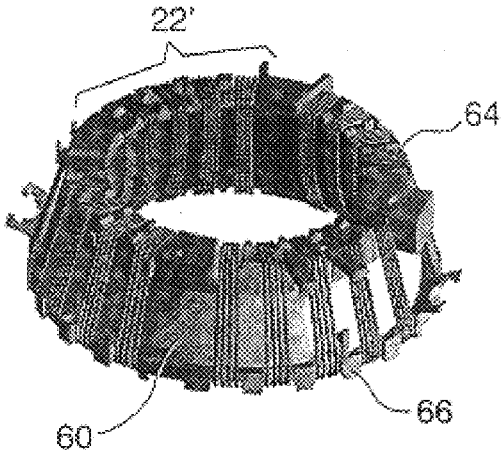
FIGS. 2A, 2B show a first and a second part of the ring-shaped element according to the invention.
Figure 2B:
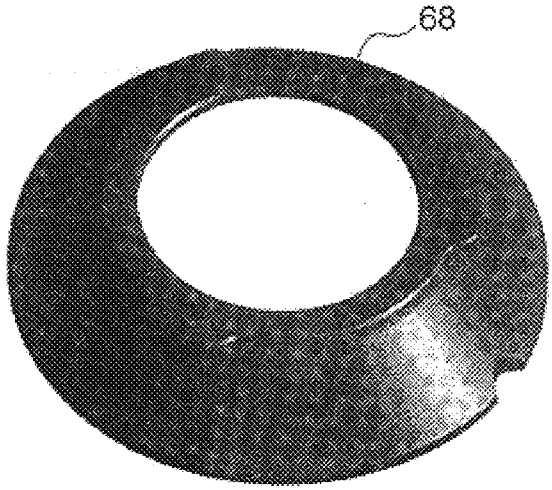

FIGS. 2A and 2B show an embodiment of the invention. FIG. 2A shows a first part 60 of the ring-shaped element 21', which part is closest to the electron gun 5. The part 60 is provided with four coils 22' for generating the magnetic quadrupole field. Coils are shown that have been wound in a toroidal way around the ring-shaped element. However, this mode of winding is not essential to the invention. The quadrupole coils can also be wound around the ring-shaped element in a saddle-like shape. To facilitate the winding process and to keep the individual wire elements of the coil 22' on the right position at the first part 60, the first part is provided on its extremities with rings 64, 66 having grooves in which the coil windings are positioned. FIG. 2B shows a second part 68 of the ring-shaped element 21', which part is closest to the display window 2. When applied to the tube, the two parts 60, 68 may be connected to each other by any conventional connection means, such as glue, tape or the like. Connection of the two parts is not essential for a proper performance.

Figure 3:
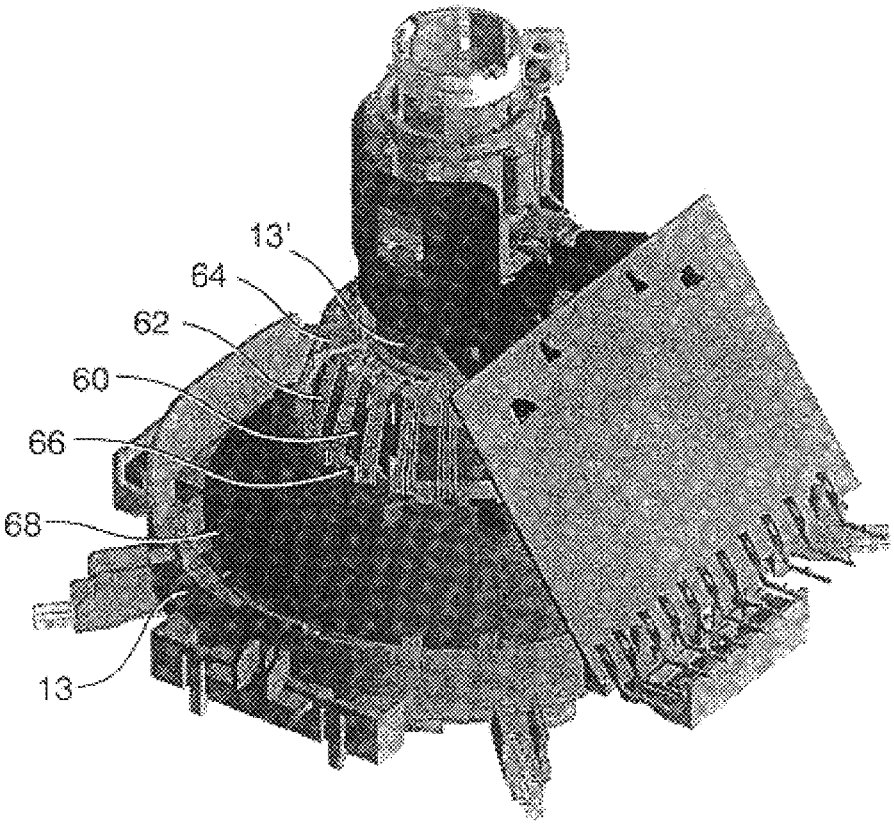
FIG. 3 shows a deflection unit according to the invention.

FIG. 3 shows the two parts 60, 68 according to the invention when 15 positioned around the deflection coils 13' and the coil holder 13. The first part 60 is provided with rings 64, 66 and four coils 22' for generating the magnetic quadrupole field.

Figure 4A:
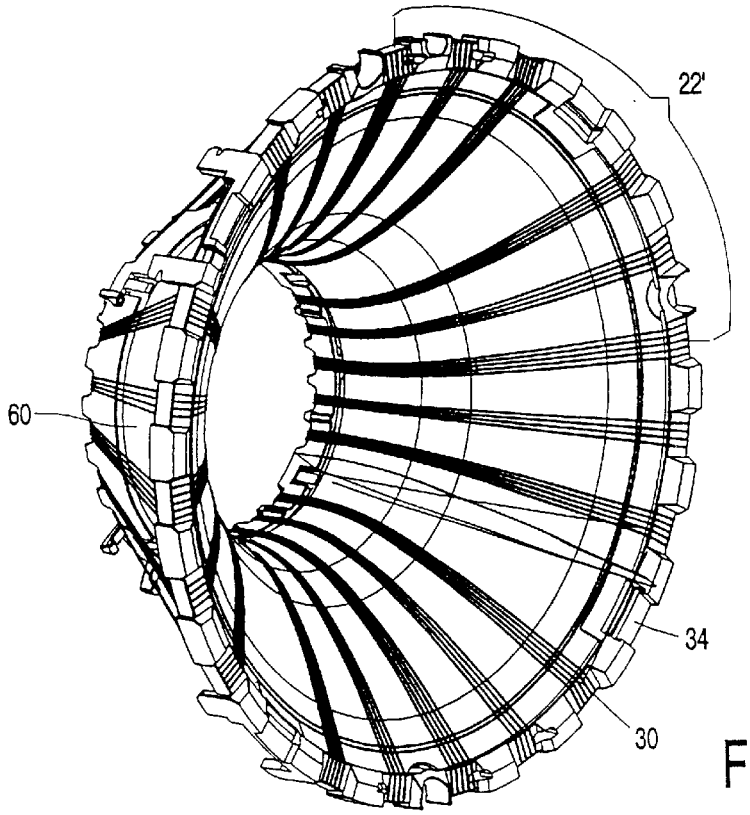
FIGS. 4A, 4B show an embodiment of the invention.
Figure 4B:
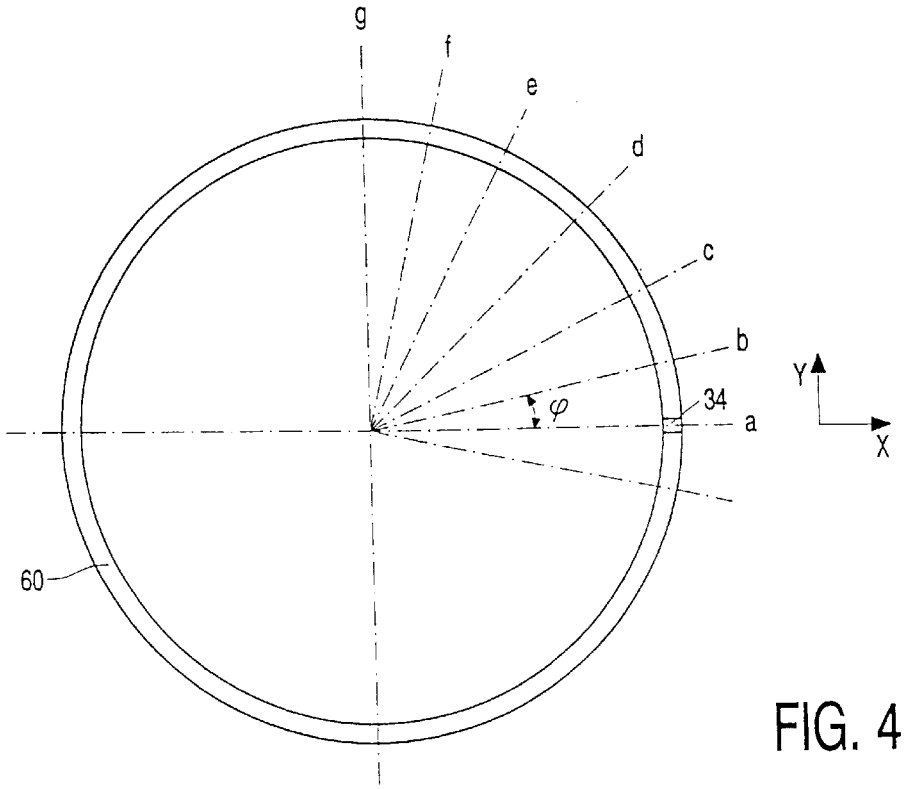

FIGS. 4A and 4B show an embodiment of the invention wherein the coils 22' around the first part 60 of the ring-shaped elements 21' are obtained from electrically conductive wires, which are toroidally wound in a winding direction and in accordance with a winding density distribution N(ϕ) given by $$N(\phi)=N_0 \cos(2\phi);$$

where ϕ is an angle enclosed by the X-direction and a line between an element of the coil and the center, which ranges between 0° and 360°, $N_0$ is the winding density at ϕ equal to 0°, and the sign of N(ϕ) denotes the winding direction.

This embodiment has the advantage that an almost pure quadrupole field can be generated, i.e. the presence of other magnetic multiple fields is largely suppressed.

Due to the finite dimensions of the wire, only an approximation of the above winding density can be realized in practice. The embodiment comprises packages 30 of electrically conductive wires which are toroidally wound around a yoke ring 21' in accordance with the above winding density $$N(\phi)=N_0 \cos(2\phi).$$

In this particular embodiment, windings have been made in grooves 34 of rings 64, 66 that are spaced 15 degrees apart, The winding method is as follows:

18 windings in a groove at ϕ=0 degrees (position a), 15 windings in a groove at ϕ=15 degrees (position b), 9 windings at ϕ=30 degrees (position c), no windings at ϕ=45 degrees (position d), 9 windings with current in an opposite direction in a groove at ϕ=60 degrees (position e), 15 windings at ϕ=75 degrees (position f), 18 windings at ϕ=90 degrees (position g), etc. This approximation to the ideal winding density N(ϕ) has proved to yield good results in practice.

In summary, the invention relates to a color display device comprising an in-line electron gun 5 for generating three electron beams 6, 7, 8, and a convergence unit 14' to dynamically influence the convergence of the electron beams and deflecting means 51 for deflecting the electron beams 6, 7, 8. The convergence unit 14' comprises a ring-shaped element 21', said ring-shaped element comprising two parts, a first part 60 being positioned closer to the in-line gun 5 than a second part 68, and the first and/or the second part having four coils 22' for generating a magnetic quadrupole field.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The use of the verb "to comprise" and its conjugations does not exclude the presence of elements or steps other than those stated in a claim. The use of the article "a" or "an" preceding an element does not exclude the presence of a plurality of such elements.

What is claimed is:

1. A color display device comprising an in-line electron gun (5) for generating three electron beams (6, 7, 8), deflecting means (51) for deflecting the electron beams (6, 7, 8), and convergence means (14') for dynamically influencing a convergence of the electron beams, the convergence means (14') comprising a ring-shaped element (21'), characterized in that said ring-shaped element (21') comprises two parts (60, 68), a first part (60) being positioned closer to the in-line electron gun (5) than a second part (68), and the first part (60) and/or the second (68) part having four coils (22') for generating a magnetic quadrupole field.

2. A color display device as claimed in claim 1, wherein the coils (22') comprise electrically conductive wires which are toroidally wound in a winding direction and in accordance with a winding density distribution $N(\phi)$ given by $N(\phi)=N_0 \cos(2\phi)$; where $\phi$ is an angle enclosed by an X-direction and a line between an element of the coil and the center, which ranges between 0° and 360°, $N_0$ is the winding density at $\phi$ equal to 0°, and the sign of $N(\phi)$ denotes the winding direction.

3. A color display device as claimed in claim 1, wherein the coils (22') comprise packages (30) of electrically conductive wires, said packages (30) being toroidally wound in a winding direction and in accordance with an approximate winding density distribution $N(\phi)$ described by $N(\phi)=N_0 \cos(2\phi)$; where $\phi$ is an angle enclosed by the X-direction and a line between an element of the package and the center, and $N_0$ is their winding density at $\phi$ equal to 0°.

4. A deflection unit (51) comprising deflection coils (13, 13') and convergence means (14') to dynamically influence the convergence of electron beams (6, 7, 8), the convergence means (14') comprising a ring-shaped element (21'), said ring-shaped element comprising two parts (60, 68), a first part (60) being positioned closer to an in-line electron gun (5) than a second part (68), and the first part (60) and/or the second (68) part having four coils (22') for generating a magnetic quadrupole field.

5. A deflection unit (51) in accordance with claim 4, wherein said coils (22') comprise electrically conductive wires which are toroidally wound in a winding direction and in accordance with a winding density distribution $N(\phi)$ given by $N(\phi)=N_0 \cos(2\phi)$; where $\phi$ is an angle enclosed by an X-direction and a line between an element of the coil and the center, which ranges between 0° and 360°, $N_0$ is the winding density at $\phi$ equal to 0°, and the sign of $N(\phi)$ denotes the winding direction.

* * * * *